US005145178A

United States Patent [19]

Ropars

[11] Patent Number: 5,145,178

[45] Date of Patent: Sep. 8, 1992

[54] GOLF GAME APPARATUS

[76] Inventor: William J. Ropars, Dover Post Office 133 Washington St., Dover, N.H. 03820

[21] Appl. No.: 698,581

[22] Filed: Apr. 19, 1991

[51] Int. Cl.[5] ..... A63B 69/36

[52] U.S. Cl. ..... 273/184 A; 273/181 C; 273/381; 273/127 R; 273/177 A; 446/418

[58] Field of Search ..... 273/184 A, 181 C, 381, 273/382, 127 R, 181 A, 181 R, 177 R, 177 A; 446/418, 419

[56] References Cited

U.S. PATENT DOCUMENTS

| | | | |
|---|---|---|---|
| 268,895 | 12/1882 | Hoar | 273/381 |
| 1,575,204 | 3/1926 | Hilty | 273/381 |
| 1,598,865 | 9/1926 | Limerick | 273/382 |
| 1,853,305 | 4/1932 | Frei | 446/419 |
| 1,961,060 | 5/1934 | McCarthy | 273/184 A X |
| 2,113,521 | 4/1938 | Torres | 273/382 |
| 2,394,802 | 2/1946 | Osborn | 273/127 R |
| 3,306,619 | 2/1967 | Brandell | 273/184 A X |
| 3,791,653 | 2/1974 | Yamada | 273/381 X |

*Primary Examiner*—George J. Marlo

[57] ABSTRACT

A golf game wherein a first ball is suspended above a putting green surface for being struck by a putted ball, and a second bell is supported above the first bell, for being struck by an airborne driven game ball, which ball includes chimes therein.

3 Claims, 4 Drawing Sheets

GOLF GAME APPARATUS

BACKGROUND

1. Field of Invention

This invention relates to the game of golf indirectly, specifically allowing the user to practice in the backyard, or any of several other locations. The target is two bells suspended over a "green" that is also included within this invention.

2. Description of the Prior Art

Currently the games available to the golfer are dealing with a specific aspect of the game. The "Putting Partner" is available to help in the putting area of golf. A large net is also sold to assist in use of "woods" and "irons" that can be set up on the backyard. These are just two examples of games that only allow for a portion of the game to be practiced at any one time.

Objects and Advantages

Accordingly, several objects and advantages of my invention are:

A) to provide the golfer with practice off the tee

B) to provide the golfer with practice in the fairway

C) to provide the golfer with practice around and on the "green"

D) to provide the golfer and others with inexpensive enjoyment of the game at any location they desire to play.

Figure 1:
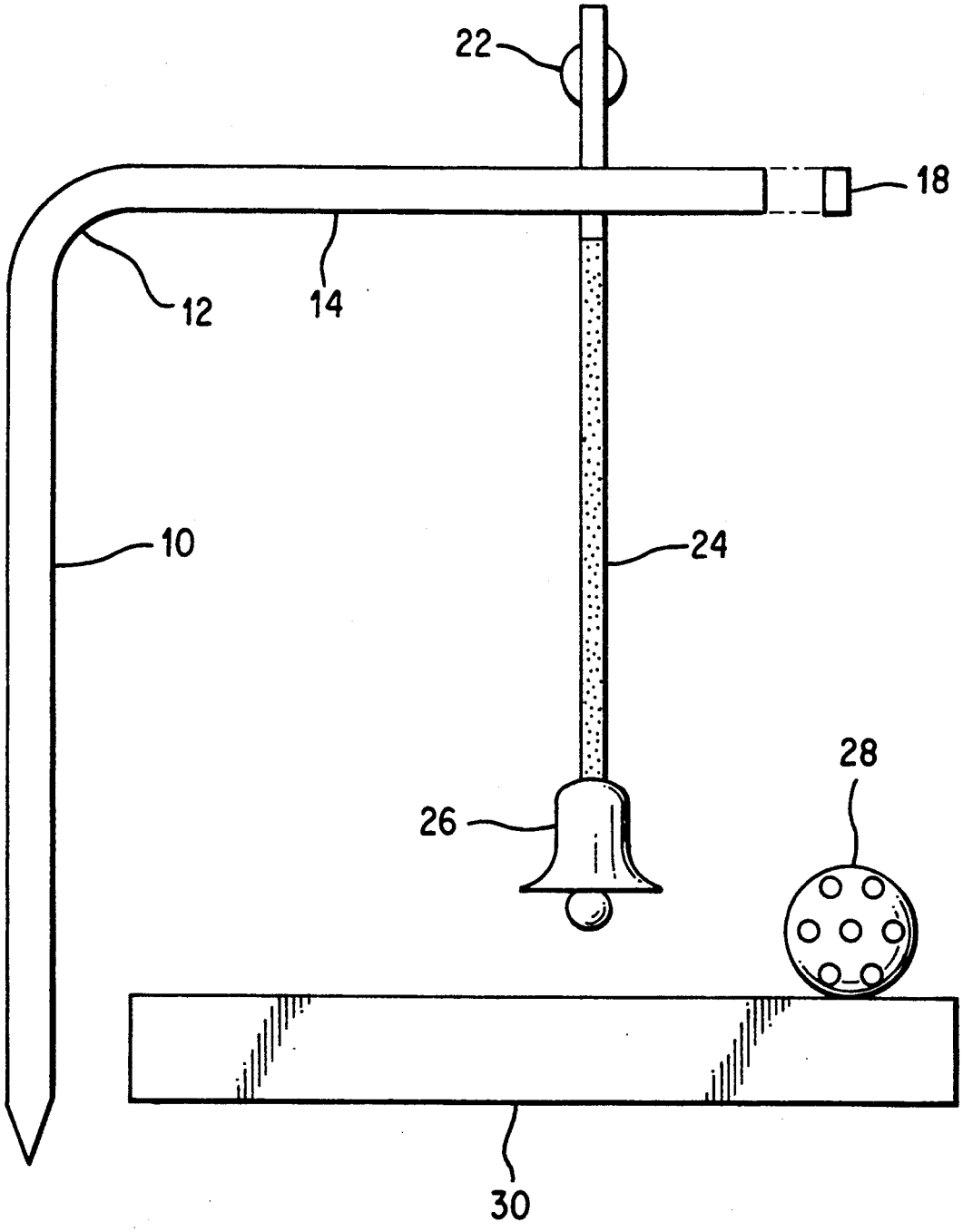

The typical embodiment of the present invention can be seen in FIG. 1. This shows the vertical pole currently, but not limited to Poly Vinyl Chloride. This connects to a currently copper, but not limited to elbow. Protruding from the open end of the elbow is another horizontal pole currently, but not limited to Poly Vinyl Chloride.

Figure 2:
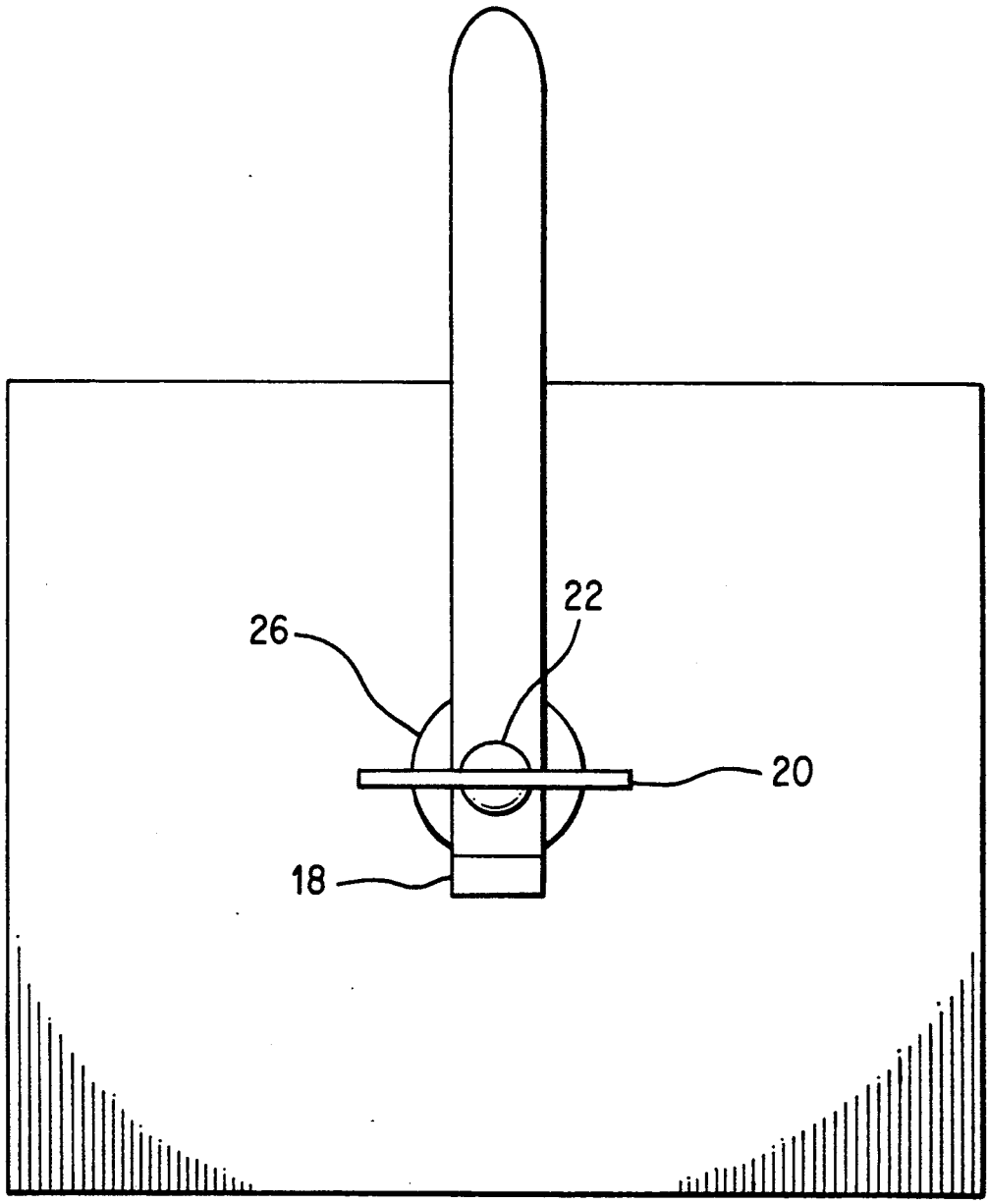

In FIG. 2 is a hole drilled all the way through the horizontal pole for attachment of the "O" Ring.

Figure 3:
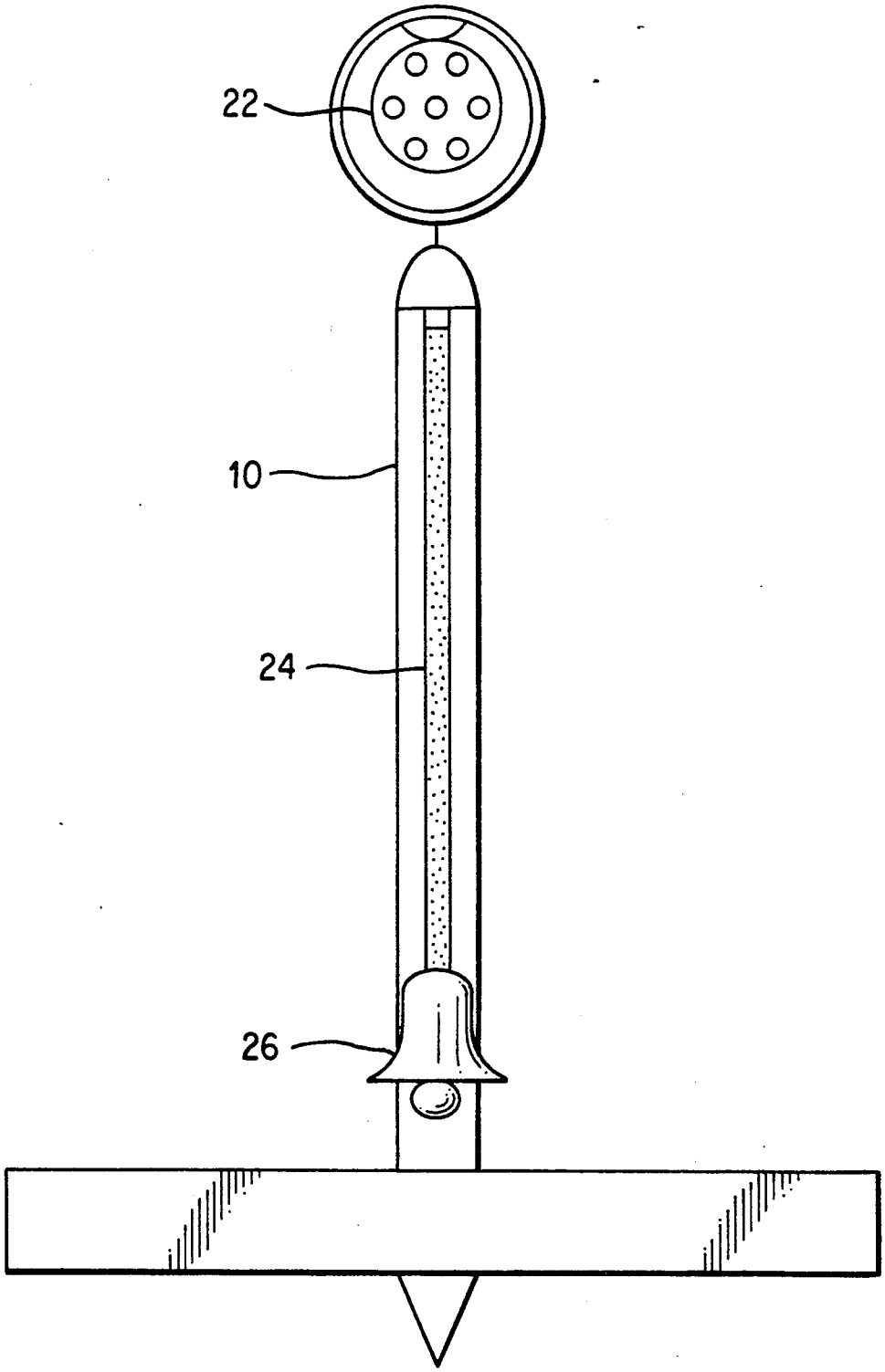

In FIG. 3 is the "bell" hanging inside of the "O" Ring.

Figure 4:
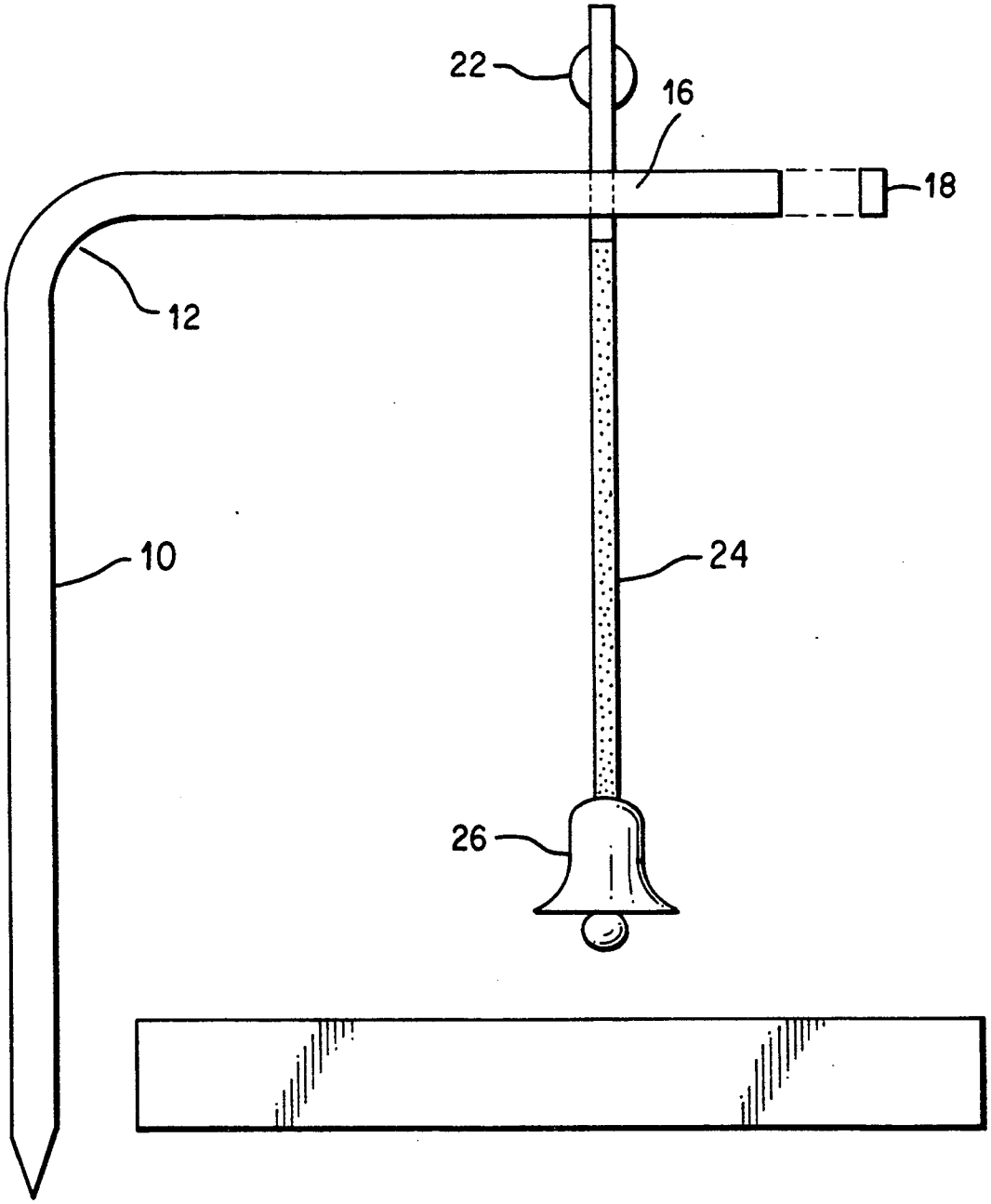

FIG. 4 shows a hole for attaching the chain to the horizontal pole. At the bottom of the chain is a bell suspending over the "green".

OPERATION—FIGS. 1, 2, 3, 4

There is a wide range of golf assistance or practice equipment available. These range from putting greens, to driving strength analysis and accuracy gages, to practice nets. By design all of these games assist the golfer in only one aspect of the sport. They either sharpen your putting skills or improve the driving accuracy or velocity. Ding-A-Ling Golf takes the theory one step further by encompassing all aspects of the game and molding them into one. This takes into account the trouble golfers have getting off the tee, the expertise need for fairway play, and finally the finesse needed around and "green". Ding-A-ling Golf not only focusses on the golfer but can be played by anyone old enough to swing a club.

The game has the basic rule structure of golf itself. The significant difference comes in by what the players are aiming for. The following is a brief overview of how the game is played. Each player is given a six shot limit from the tee-off to the ringing of either bell on the green. The players take turns teeing off from a specified location that they choose themselves. Play continues through the "fairway" and up to the "green". When around the "green" there are two targets that each player is aiming for. They are both bells, one suspended by a chain down to the "green", and the other suspended on top of the horizontal pole in an "O" Ring. When the bell in the "O" Ring is struck it is an automatic 1 on the players' scorecard. When the lower bell is struck the players' must count their strokes and mark this down as their score. Only one of the two bells are to be struck on each hole.

DRAWING FIGURES

The following is a brief description of each part that is contained within Ding-A-Ling Golf.

Part 10—shows a rigid plastic pole with a dimension of $12'' \times \frac{1}{2}''$.

Part 12—shows a copper elbow $\frac{1}{2}''$ in diameter.

Part 14—shows a rigid plastic pole with a dimension of $10\frac{1}{2}'' \times \frac{1}{2}''$.

Part 16—shows a hole drilled completely through the pole.

Part 18—shows a plastic cap for part 14 pole.

Part 20—shows a plastic "O" ring with a diameter of $3\frac{1}{2}''$.

Part 22—shows a circular "bell".

Part 24—shows a chain of 6" in length.

Part 26—shows a bell with a $1\frac{1}{2}''$ diameter.

Part 28—shows a Ding-A-Ling Golf Ball.

Part 30—shows a piece of plywood $2' \times 3'$. Covering the plywood is a piece of "Astroturf" of the same dimension.

I claim:

1. A recreational golf game comprising:

(a) a means for supporting a first ringing device above the ground such that it can be struck by a rolling ball and (b) a means for supporting a second ringing device above the first ring device, such that the second ringing device can be struck by a ball in the air.

2. The golf game of claim 1 in which the ball comprises a ball with chime devices.

3. The golf game of claim 1 which further comprises a sheet of grassy material to be placed under the first ringing device.

* * * * *